US007513633B2

(12) United States Patent
Ermeti

(10) Patent No.: US 7,513,633 B2
(45) Date of Patent: Apr. 7, 2009

(54) EMERGENCY LIGHTING DEVICE AND SYSTEM

(75) Inventor: Richard Scott Ermeti, Redondo Beach, CA (US)

(73) Assignee: Pelican Products, Inc., Torrance, CA (US)

( * ) Notice: Subject to any disclaimer, the term of this patent is extended or adjusted under 35 U.S.C. 154(b) by 31 days.

(21) Appl. No.: 11/304,451

(22) Filed: Dec. 14, 2005

(65) Prior Publication Data

US 2007/0133196 A1 Jun. 14, 2007

(51) Int. Cl.
*F21V 9/16* (2006.01)

(52) U.S. Cl. ..... 362/84; 362/208; 362/191; 206/573; 248/309.1; 248/313; 248/316.1

(58) Field of Classification Search ..... 362/84, 362/208, 189, 800, 159, 190, 191, 202; 206/573; 248/309.1, 313, 316.1
See application file for complete search history.

(56) References Cited

U.S. PATENT DOCUMENTS 4,750,095 A * 6/1988 Huang ..... 362/190
5,413,223 A * 5/1995 Kang ..... 206/573
5,752,761 A * 5/1998 Pietruczynik et al. ..... 362/84
6,179,431 B1 * 1/2001 Chien ..... 362/84
6,386,730 B1 * 5/2002 Matthews ..... 362/184
6,435,689 B2 * 8/2002 Pitts ..... 362/84
7,033,042 B2 * 4/2006 Lim ..... 362/202
7,077,541 B1 * 7/2006 Prioa ..... 362/190
2001/0033481 A1 * 10/2001 Chien ..... 362/34
2003/0221357 A1 * 12/2003 Parsons ..... 43/4.5

* cited by examiner

*Primary Examiner*—Jacob Y Choi
(74) *Attorney, Agent, or Firm*—Greenberg Traurig LLP

(57) ABSTRACT

An emergency lighting device and system comprising a lighting device is disclosed. The lighting device may comprise with photo-luminescent plastic to make the lighting device visible in the dark. In particular embodiments, a bracket in a storage container capable of being mounted on a wall secures a flashlight in the storage container. Utilization of the system with a flashlight enables the individual to move to a safer location, find their way out of the area, or to help others without an emergency light station nearby.

15 Claims, 2 Drawing Sheets

EMERGENCY LIGHTING DEVICE AND SYSTEM

BACKGROUND

1. Field

The present disclosure relates to emergency lighting devices and systems, and more particularly to a lighting device comprising luminescent materials.

2. Background

The use of emergency lighting systems in case of power failure or other emergencies is well known. The purpose of these systems is to provide individuals with a source of light to enable seeing during an emergency.

Many current emergency lighting systems are hard-wired into the electrical system. The emergency lights are not movable and require maintenance to make sure the system is working properly.

SUMMARY

In one aspect of the present disclosure, an lighting device to assist individuals in leaving a building in an emergency is disclosed. The lighting device includes a flashlight that can be easily removed and carried with the individual to assist in leaving the building.

In another aspect, at least some portion of the lighting device normally exposed to light is comprised of a luminescent material. Utilization of photo-luminescent plastic allows the lighting device to illuminate in the dark. In particular embodiments, the flashlight will be formed from photo-luminescent plastic.

In another aspect, the emergency lighting device is easily mountable to a wall at any desired location. A storage base contains several holes to enable mounting of the device to the wall with screws, nails or other similar fasteners.

In one aspect of the present disclosure, brackets are fixed to the storage base. The flashlight is secured to the storage base by inserting the flashlight into the brackets.

In yet another aspect, the flashlight contained in the device may be an LED flashlight. An LED flashlight is a very powerful flashlight that requires little energy to run and lasts a long time before burning out In a further aspect, the flashlight further comprises long-term batteries. Utilization of long-term batteries will ensure that very little maintenance is required to maintain the emergency lighting device.

In one aspect, a storage container is provided to enclose the flashlight in the device. The storage container may be transparent to enable the individual to see the flashlight therein. The storage container may also comprise photo-luminescent in partial or whole to enable the individual to see the device.

In another aspect, after an emergency has occurred, the flashlight can be returned to the storage base in case of future need.

In yet another aspect of the present disclosure, an emergency lighting system is disclosed wherein a plurality of emergency lighting devices are utilized in various locations in a building.

DRAWINGS

The foregoing aspects and advantages of this invention will become more readily apparent and understood with reference to the following detailed description, when taken in conjunction with the accompanying drawings, wherein.

DETAILED DESCRIPTION

In one embodiment of the present disclosure, a lighting device comprising a barrel for receiving a battery 200, the barrel having a longitudinal axis and extending between a top and a base, a head on the barrel having a lens and a bulb 260, a switch 240 with an electrical contact for permitting electrical closure and opening of an electrical circuit 220 between the battery and the bulb thereby to permit operation of the lighting device to be on or off according to the position of the switch, and wherein at least some portion of the lighting device that is normally exposed to light comprises a luminescent material.

At least some portion of the lighting device normally exposed to light comprises a luminescent material so that the lighting device may be located by a user in the dark. The portion may be formed from photo-luminescent plastic. After being exposed to light, the photo-luminescent materials illuminate in the dark. Other approaches are also contemplated to generate the luminescent effect. For example, a covering or sleeve may be placed on the lighting device that is photo-luminescent.

The lighting device may further comprise a mountable storage base and an attachment mechanism to affix the lighting device to the storage base. In an exemplary embodiment, the storage base is a container.

Figure 1:
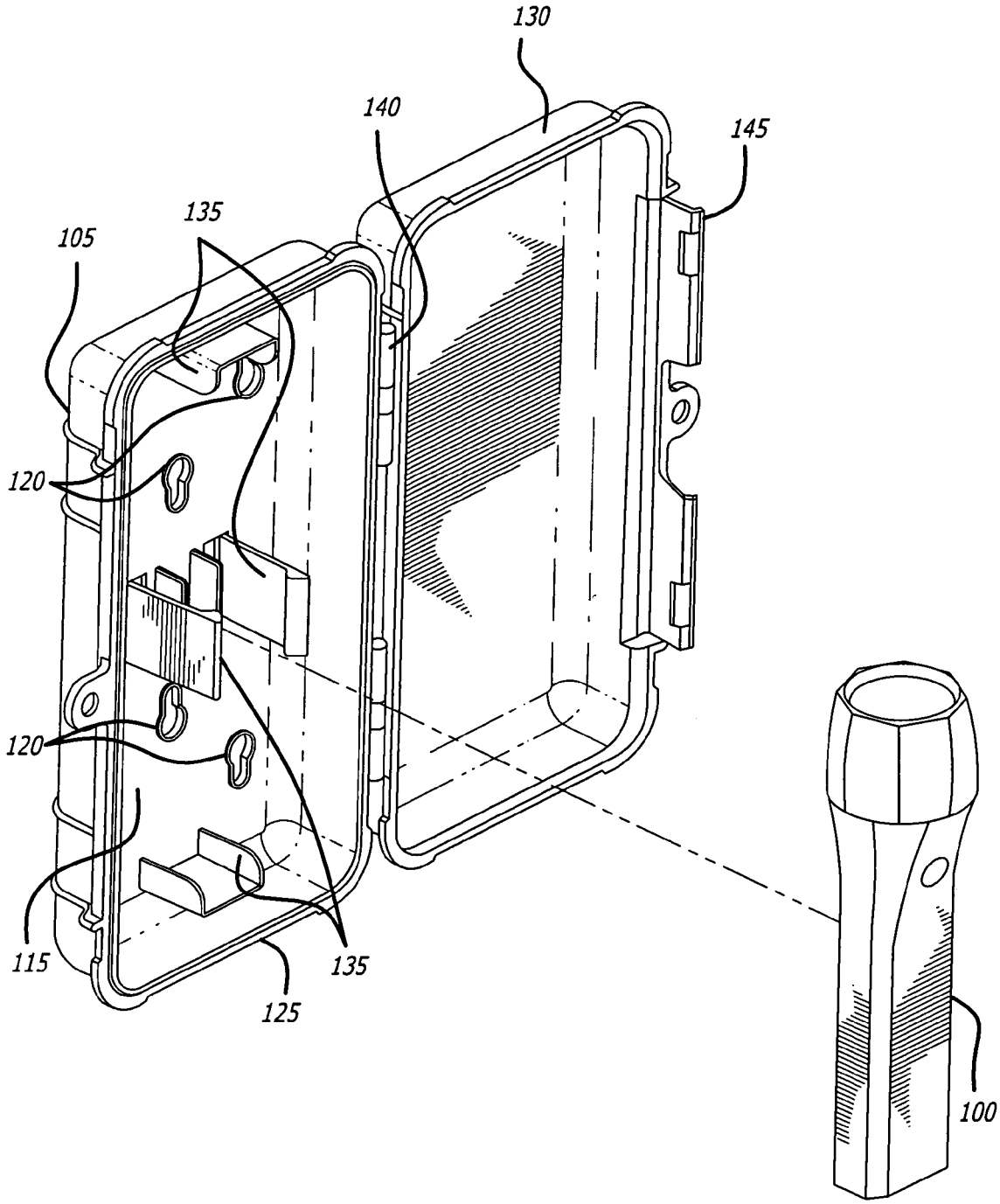
FIG. 1 depicts one embodiment of the lighting device comprising a flashlight with the flashlight removed from the storage container.

FIG. 1 depicts one embodiment of a lighting device wherein the flashlight 100 is been removed from the storage container 105. Utilization of a flashlight 100 in the device allows for easy removal of the flashlight from the storage container and movement of the emergency light. This is beneficial as it allows an individual to find a light source during a blackout and remove the light source illuminating the surrounding area and assisting exit of the building or location. If necessary, use of the device with a flashlight 100 enables the individual to move to a safer location, find their way out of the area, or to help others without an emergency light station nearby.

The flashlight is normally stored in the non-illuminated position. The user of the device may turn on the device during an emergency utilizing the switch. In one embodiment of the emergency lighting device, to facilitate finding the device in an emergency, the flashlight 100 is formed from photo-luminescent plastic. In an emergency, when the lights go out, the photo-luminescent plastic will illuminate in the dark enabling an individual to find their way to the flashlight 100.

In an exemplary embodiment, the flashlight 100 comprises long-term batteries. The use of long-term batteries enables very little maintenance for the individual using the emergency lighting device. Additionally, the flashlight 100 may be an LED flashlight. LED flashlights require little energy to run and lasts a long time before burning out. This feature again allows very little maintenance for the individual using the lighting device, which in turn may be used a number of years.

Another feature of the emergency lighting device is that the storage container 105 can be placed anywhere, by hanging the storage container 105 on a wall. This enables the user of the device to choose where the light source is placed, and move the storage container 105 for changed circumstances.

In an exemplary embodiment, the storage container 105 is comprised of first half 125 and a second half 130. The first half 125 of the container further comprises the storage base 115. The first half 125 of the storage container 105 is attached to the second half 130 by a hinge 140. The second half can then rotate about the edge of the first half 130 to open the container 105 enabling an individual to retrieve the flashlight 100. The storage container 105 further comprises a latch to fasten the first half 125 of the container 105 to the second half.

Fixed on the storage base 115 of the container 105 is a bracket 135. In particular embodiments, the flashlight is placed into the storage container by securing the flashlight in the bracket 135. In other embodiments, other attachment mechanisms are also contemplated to secure the flashlight to the storage base.

The storage container 105 is hung one the wall utilizing screws, nails, or similar hanging means through the holes 120 located in the storage base 115 of the storage container. Other techniques are also contemplated to mount the storage container 105 on a wall.

In a particular embodiment, the storage container 105 is comprised of a transparent plastic. This enables the flashlight 100 to be seen when the photo-luminescent plastic is illuminated in the dark. Additionally, the storage container 105 may at least partially comprise photo-luminescent plastic. This may facilitate an individual finding the source of light in case of an emergency.

Figure 2:
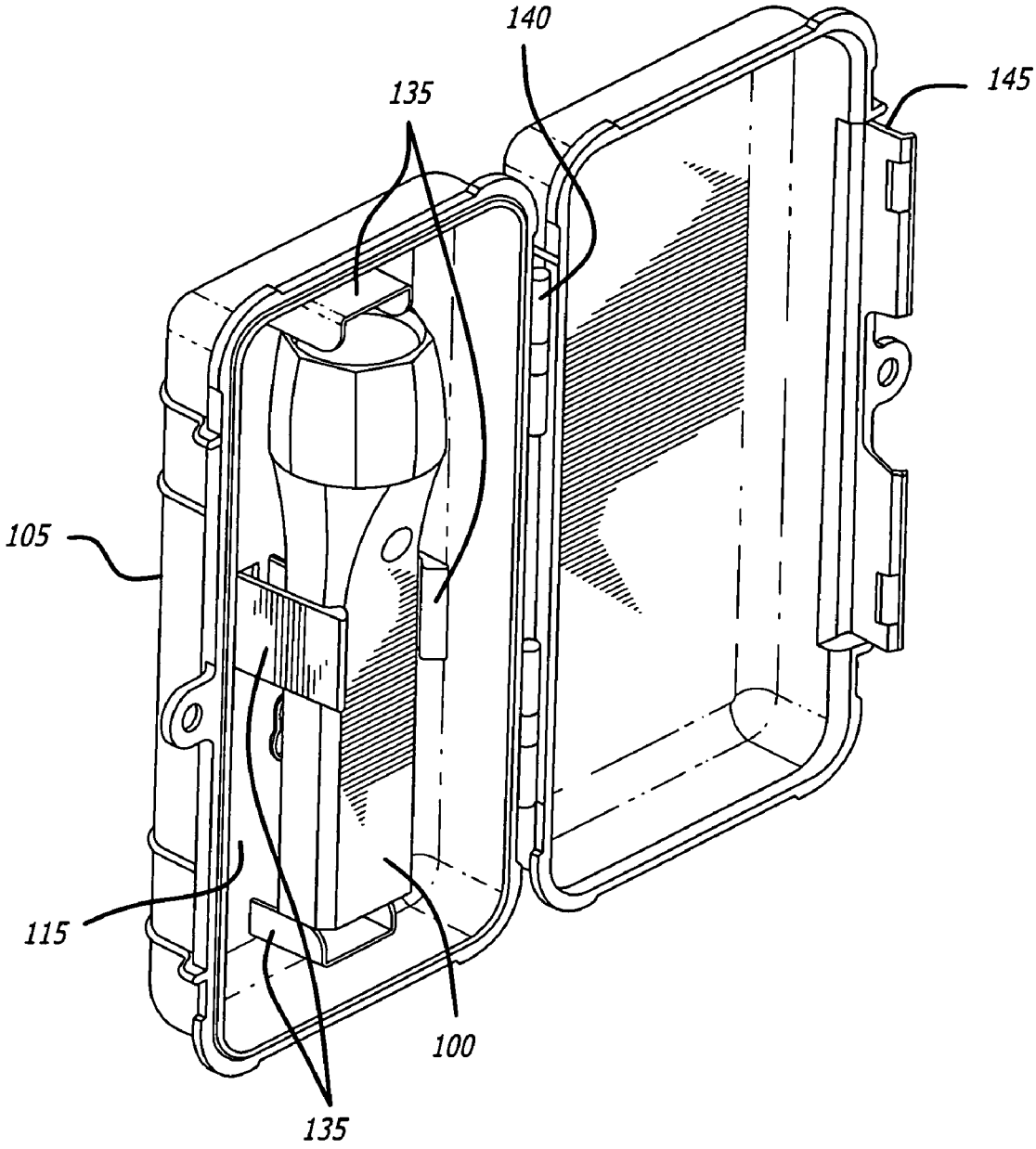
FIG. 2 depicts the emergency lighting device with the flashlight locked into the storage container.

Referring now to FIG. 2, the emergency lighting device is depicted with the flashlight 100 secured in the brackets 135 located on the base 115 of the storage container 105. The flashlight 100 is fully enclosed in the storage container 105. Utilization of a storage container will prevent individuals from using the flashlight in a non-emergency situation.

In particular embodiments, a emergency lighting system may be provided by utilizing a plurality of the lighting devices. In this system, a plurality of storage bases will be placed at strategic locations around a building. Flashlights will be placed into these storage bases to enable multiple users located at different locations in the building to locate a lighting device in case of an emergency such as a blackout.

Additionally, when the emergency or necessity to use the flashlight is no longer needed, the flashlight may be simply returned to the storage container for future need.

In a particular embodiment, the lighting device may also include a recharger for the batteries. The lighting device may then be plugged in to an outlet to maintain a charge for the system. The charge may be used to supplement the luminescence of the lighting device to enable users to find the lighting device.

While the above description contains many particulars, these should not be considered limitations on the scope of the invention, but rather a demonstration of embodiments thereof. The alloy composition, method for making and uses disclosed herein include any combination of the different species or embodiments disclosed. Accordingly, it is not intended that the scope of the invention in any way be limited by the above description. The various elements of the claims and claims themselves may be combined any combination, in accordance with the teachings of the present disclosure, which includes the claims.

The invention claimed is:

1. A lighting device comprising:

a storage container, the storage container comprising a first half and a second half, the first half including a storage base for engaging with a foundation at a desired location;

a flashlight, the flashlight including a barrel for receiving a battery, the barrel having a longitudinal axis and extending between a top and a base, a head on the barrel having a lens and a bulb, a switch with an electrical contact for permitting electrical closure and opening between the battery and the bulb thereby to permit operation of the flashlight to be on or off according to the position of the switch;

a bracket fixed to the storage base to secure the flashlight; a protrusion in the storage container located on the storage base to extend above the storage base, the protrusion being for propping the secured flashlight in a position such that the barrel is spaced from the storage base, thereby facilitating removal of the flashlight from the storage container; and wherein at least one of the barrel or the head is a molded luminescent material and wherein the first half and second half of the storage container define walls of the interior space and that the flashlight is substantially suspended relative to the walls of the interior space by the protrusion such that the flashlight does not contact the walls of the first half of the storage container.

2. The lighting device of claim 1 wherein the flashlight comprises an LED flashlight.

3. The lighting device of claim 1 wherein the storage container is transparent.

4. The lighting device of claim 1 wherein the protrusion is located between the bracket.

5. The lighting device of claim 1 wherein the bracket is located on the storage base at the head, the base, and the sides of the barrel of the secured flashlight.

6. The lighting device of claim 1 wherein the base is essentially flat from end to end.

7. An emergency lighting device comprising:

a transparent storage container to be mounted at a desired location, the storage container comprising a first half and second half, the first half including a storage base for engaging with a foundation at a desired location;

a flashlight molded form photo-luminescent plastic, the flashlight including a flat barrel for receiving a battery, the flat barrel having a longitudinal axis, a latitudinal height, and a latitudinal width, wherein the flat barrel extends longitudinally between a top and a base, and the latitudinal height is greater than the latitudinal width, a head on the barrel housing a lens and a bulb, a switch with an electrical contact for permitting electrical closure and opening between the battery and the bulb thereby to permit operation of the flashlight to be on or off according to the position of the switch;

a bracket fixed to the storage container to secure the flashlight in the storage container;

a protrusion in the storage container located on the storage base to extend above the storage base, the protrusion being for propping the secured flashlight in a position such that the barrel is spaced from the storage base, thereby facilitating removal of the flashlight from the storage container; and wherein the first half and second half of the storage container define walls of the interior space and that the flashlight is substantially suspended relative to the walls of the interior space by the protrusion such that the flashlight does not contact the walls of the first half of the storage container.

8. The lighting device of claim 7 wherein the flashlight is removable from the storage container for use as a flashlight.

9. The lighting device of claim 7 wherein the flashlight comprises an LED flashlight.

10. The lighting device of claim 7 wherein the flashlight comprises long-life batteries.

11. The lighting device of claim 7 wherein the storage container further comprises photo-luminescent plastic forming at least a portion of the container.

12. The lighting device of claim 7 wherein the storage container further comprises a door on a hinge.

13. The lighting device of claim 7 wherein the protrusion is located between the bracket.

14. The lighting device of claim 7 wherein the bracket is located on the storage base at the head, the base, and the sides of the barrel of the secured flashlight.

15. The lighting device of claim 7 wherein the base is essentially flat from end to end.

* * * * *